United States Patent [19]

Andraé et al.

[11] Patent Number: 4,610,431

[45] Date of Patent: Sep. 9, 1986

[54] ADJUSTABLE LOAD SUPPORT

[75] Inventors: Wolfhart Andraé; Hans P. Andraé, both of Stuttgart; E. H. Erwin Beyer, Düsseldorf; Karl Bayer, Grosserlach; Manfred Lohmann, Neuhausen, all of Fed. Rep. of Germany

[73] Assignee: SHW Schwabische Huttenwerke GmbH, Aalen-Wasseralfingen, Fed. Rep. of Germany

[21] Appl. No.: 712,993

[22] Filed: Mar. 18, 1985

[30] Foreign Application Priority Data

Mar. 21, 1984 [DE] Fed. Rep. of Germany ..... 3410275

[51] Int. Cl.[4] ..... B25B 1/20

[52] U.S. Cl. ..... 254/93 HP

[58] Field of Search ..... 254/93 HP, 93 R; 269/22, 266, 267, 224

[56] References Cited

U.S. PATENT DOCUMENTS

| | | | |
|---|---|---|---|
| 1,453,176 | 4/1923 | Perrine | 269/267 |
| 2,396,413 | 3/1946 | Egger | 254/93 HP |
| 3,499,641 | 3/1970 | Peterson | 269/22 |
| 4,159,107 | 6/1979 | McArthur | 269/266 |

FOREIGN PATENT DOCUMENTS

| | | | |
|---|---|---|---|
| 1260118 | 3/1961 | France | 254/93 HP |
| 1049418 | 9/1980 | U.S.S.R. | 254/93 HP |

*Primary Examiner*—Robert C. Watson

*Attorney, Agent, or Firm*—Collard, Roe & Galgano

[57] ABSTRACT

An adjustable load support for lifting, lowering, and transferring heavy loads is provided, comprising a hollow container having a bottom, side walls, and a liftable top. A portion of the top protrudes into the interior of the container. An elastomeric mass substantially fills the remainder of the interior of the container. Sealing elements are also provided which seal the portion of the top of the container extending into the interior of the container with the side walls. A substantially flat diaphragm is located between the elastomeric mass and the bottom of the container. The diaphragm is substantially parallel to the plane of the bottom of the container but is not in contact with the side walls of the container. Means for introducing a pressurized medium between the diaphragm and the elastomeric mass through an opening in the diaphragm is also provided. When the pressurized medium is introduced into the container between the diaphragm and the elastomeric mass, the top of the container is lifted. Conversely, when the pressurized medium is let out of the container, the top of the container is lowered.

10 Claims, 3 Drawing Figures

ADJUSTABLE LOAD SUPPORT

BACKGROUND OF THE INVENTION

This invention relates to an adjustable load support for the lifting, lowering, and transfer of heavy loads. Such supports find particular use in connection with the movement of structural frameworks at construction sites, especially bridge construction sites.

Adjustable load supports of the type hereinafter described are typically constructed with a hollow container or receptacle. The container is usually made of steel and is either circular or rectangular in shape. A covering plate, also of steel, sits atop the container and protrudes partly into the interior of the container. The cover plate can be moved upwards or downwards. The cover plate together with the side walls of the container and its bottom form an enclosed pressurized compartment.

Inside the pressurized compartment, there is a mass of elastomeric material which substantially fills the interior of the compartment. This elastomeric mass is capable of deforming itself elastically when it is subjected to pressure. Special sealing elements are arranged on the underside of the cover plate near the region where the cover plate meets the side walls. Alternatively, the special sealing elements may be located in a channel of the elastomeric mass, said channel being located near the region where the cover plate meets the side walls. The purpose of the special sealing elements is to prevent the elastomeric material from being trapped inside the gap between the cover plate and the side walls when the elastomeric mass is subjected to high pressure. The sealing elements also prevent escape of the elastomeric material into the exterior of the pressurized compartment when it is subject to high pressure.

This type of load support has the additional feature that the cover plate on which the structural framework or bridge part rests can be tilted up to a certain angle with the horizontal. This can be accomplished by compressing the elastomeric mass on one side only. The covering plate will then incline itself at an angle without generating excessive friction because of the elasticity and flexibility of the edge sealing elements.

Load supports of this type can also be used for lifting and lowering heavy loads, such as structural frameworks for buildings or bridges, when they are provided with means for introducing a pressurized medium into the hollow compartment. When this is done, the pressurized medium exerts a force on the elastomeric mass causing the volume enclosed within the compartment to increase so that the cover plate bearing the structural framework lifts upwards. When the pressurized medium is removed from the compartment, the enclosed volume is reduced and the cover plate with the structural framework atop is lowered.

Height-adjustable load supports of this type are useful in many different kinds of tasks. They are useful in the construction of bridges or other heavy objects where one must contend with a sinking subsoil or foundation. Such sinking can be compensated for by elevating the load supports. When the sinking is too great and the load supports cannot be elevated sufficiently, the load supports must be removed and the base underneath must be raised. In instances such as this, adjustable load supports are used to raise the structural framework or the bridge so that previous load supports can be removed. It may also be necessary to raise the load in order to inspect the supports underneath or to change them. In such cases as well, adjustable load supports are needed to lift and then lower the structural framework or the bridge. Depending on the circumstances, it may suffice to build in new adjustable load supports and remove the old supports.

Adjustable load supports which have been used in the past have had problems associated with them. For example, in German Patent DE-PS No. 1759032, an adjustable load support is described wherein a pressurized medium is introduced into the pressurized compartment below the elastomeric mass via a hydraulic pressure line at the bottom of the pressurized compartment. In this patent, the pressurized medium is a plastic or elastic material which is forced into the hollow compartment on the bottom of the compartment and below the elastomeric material. This causes the cover plate to be displaced upwards. Thus, there is formed below the elastomeric mass a more or less uniform layer of the new material which has been forced in via the pressure line. Because of the non-compressibility of the elastomeric mass, the volume within the pressurized compartment is enlarged by the material which is forced into it, whereby the cover plate rises under the load of the construction material resting thereon. A disadvantage of the adjustable load support described in this German patent is that the material forced into the pressurized compartment distributes itself in a wholly uncontrollable manner between the bottom of the container and the elastomeric mass. When the cover plate is raised to a high elevation, the pressurized medium may sometimes enter the gap between the side walls and the elastomeric mass despite the presence of the sealing elements. It is also possible for the pressurized medium to flow out of this gap to the exterior of the adjustable load support. This is especially likely to occur when the load is especially heavy and the sealing elements are worn away after a number of tilting movements of the cover plate.

This problem is avoided by the adjustable load support which is described in German Patent DE-AS No. 2527128. In the adjustable load support described in this German patent, a membrane bubble made from an elastic material is introduced between the elastomeric mass and the bottom of the container. The membrane bubble is connected to and is contiguous with the inside of the side walls. A pressure line is used to introduce the pressurized medium into the compartment beneath the membrane bubble. In this case, hydraulic oil is used as the preferred pressurized medium.

However, the adjustable load support of DE-AS No. 2527128 is also not free from difficulties. These difficulties arise from the fact that the membrane bubble is contiguous with the side walls of the compartment (and also extend into the sharp corners of the compartment when the compartment is rectangular in shape). For example, when the cover plate is raised, lowered, or tilted, the membrane bubble which is firmly pressed against the side walls of the container cannot follow the movement of the cover upwards without exerting considerable frictional force against the side walls. This will cause the flexible material of the membrane bubble to distend and, because of the friction against the side walls, lead to rapid wear-and-tear. The flexible bubble membrane cannot withstand such stresses, especially the dynamic overstresses which arise from the tilting movements, and which quickly lead to loosening of the bubble membrane from the side walls. When this occurs, the adjustable load support becomes unusable for lifting and lowering heavy loads.

In addition, the adjustable load support described in DE-AS No. 2527128 encounters sealing problems in connection with the pressure line that runs through the bottom of the container.

To remedy these problems, it has been proposed to insert a flexible, elastic membrane bubble between the elastomeric mass and the bottom of the compartment, wherein the membrane bubble is attached to the bottom of the compartment in a non-displaceable, fluid-proof manner. If, now, a pressurized medium, is forced through the bottom of the container below the membrane bubble, the membrane bubble will curve upwards and will also displace the elastomeric mass upwards. Depending on the quantity of pressurized medium which is forced into the container, the cover plate will rise upwards to a certain degree. In order to lower the load, a quantity of pressurized medium is bled out from the compartment. However, this solution is not entirely satisfactory either. An adjustable load support of this nature will place great stress on the bubble membrane as it is forced to distend. Loosening of the bubble membrane from the bottom of the compartment is also quite likely.

SUMMARY OF THE INVENTION

In accordance with the present invention, an adjustable load support for lifting, lowering, and transferring heavy loads is provided, comprising a hollow container having a bottom, side walls, and a liftable top. A portion of the top protrudes into the interior of the container. An elastomeric mass substantially fills the remainder of the interior of the container. Sealing elements are also provided which seal the portion of the top of the container extending into the interior of the container with the side walls. A substantially flat diaphragm is located between the elastomeric mass and the bottom of the container. The diaphragm is substantially parallel to the plane of the bottom of the container but is not in contact with the side walls of the container. Means for introducing a pressurized medium between the diaphragm and the elastomeric mass through an opening in the diaphragm are also provided. When the pressurized medium is introduced into the container between the diaphragm and the elastomeric mass, the top of the container is lifted. Conversely, when the pressurized medium is released from the container, the top of the container is lowered.

By means of the present invention, the problems heretofore described are overcome. There is no longer required a membrane bubble of a flexible or elastic material connected to the side walls, and therefore, all the problems associated therewith are avoided. There is also no longer required a similar membrane that needs to be attached to the bottom of the container and that is likely to loosen quickly and create problems. Rather, more efficient use is made of the elasticity of the elastomeric mass.

Desirably, the pressurized medium in the present invention is a fluid, for instance hydraulic oil or a viscous material.

The present invention may be adapted for use in load supports capable of very high elevations. For such uses, it is desirable that there be several openings for introducing the pressurized medium into the compartment between the diaphragm and the elastomeric mass. These openings should be distributed evenly throughout the diaphragm in order to achieve quicker and more uniform distribution of the pressure medium in the hollow region between the diaphragm and the elastomeric mass. In another embodiment, each opening in the diaphragm is also in fluid communication with a nozzle connected to the pressure line which can be used to bleed away the pressure medium. The nozzle fits into a depression in the elastomeric mass and is releasably attached to the bottom of the container. In this way, the load can be lowered rapidly.

In a preferred embodiment, the edge of the diaphragm does not extend to the sidewalls but is at a distance equal to about $\frac{1}{8}$ to 1/12 of the diameter of the interior of the compartment from the side walls. In this manner, overstressing at the edges of the elastomeric mass is substantially reduced. Even in the event such an overstress should occur, and the elastomeric mass should tear locally near the edge, no damage would result. Any pressure medium which forces its way upwards into the gap between the elastomeric mass and the side walls would be contained by the surrounding sealing elements. Even in the more unlikely event that the pressure medium leaks through the sealing elements and passes to the exterior, no damage would result. This would merely cause the load supports to sink somewhat and the loosened area would soon be closed again by the elastomeric mass forcing itself against the side walls. The load supports would thus remain fully operative.

In order to further protect the edges of the elastomeric mass against overstress from impacts, it is desirable in the present invention to provide the diaphragm with a surrounding ring made from metal or an artificial material on its outer edge. This ring protects the elastomeric mass from grinding against the edge of the diaphragm when fluid is introduced into the compartment. In another embodiment, the outer edge of the diaphragm is provided with upwardly curving reinforcements into which a surrounding metal ring is embedded.

DETAILED DESCRIPTION OF THE INVENTION

Figure 1:
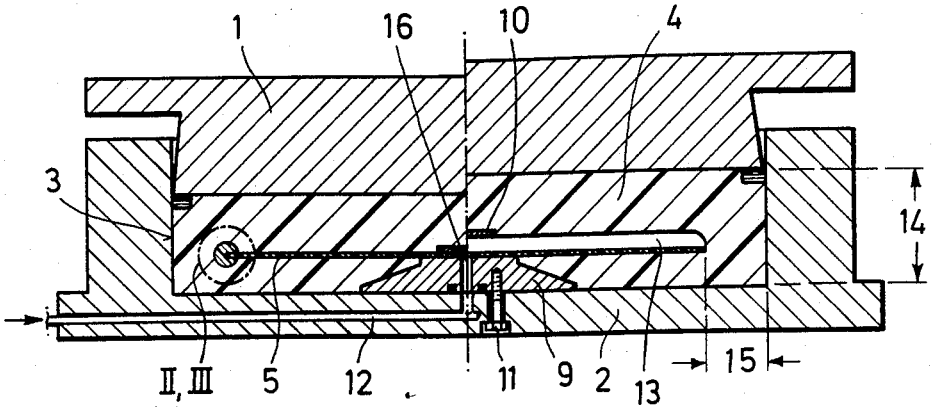
FIG. 1 shows in cross-section an adjustable load support of the present invention, the left half of which is in the lowered position while the right half is in the raised position.

Referring to FIG. 1, an adjustable load support of the present invention is illustrated therein. In the left half of FIG. 1, there is shown the adjustable load storage in the lowered position while the right half of FIG. 1 shows it in raised position. The adjustable load support comprises a cover plate 1, a bottom 2, and side walls 3. These structures define a pressurized compartment designated 14.

The adjustable load support further comprises an elastomeric mass which substantially fills the interior of the compartment, a diaphragm 5 parallel to the bottom of compartment 14 and located between the bottom 2 and the elastomeric mass 4. Diaphragm 5 is made from an artificial material or from metal, preferably from an artificial material, and is coated with a separating agent in order to prevent direct contact with the elastomeric mass. On its underside, the diaphragm 5 is in contact with nozzle 9, which, in its middle part, is provided with channel 12 for introduction of the pressure medium. The nozzle 9 together with the diaphragm 5 are releasably connected to the bottom 2 of the container by screw 11.

An orifice, designated 16, is provided in diaphragm 5 through which the pressure medium is introduced between diaphragm 5 and elastomeric material 4 for forming chamber 13. As can be seen in FIG. 1, the height 14 of elastomeric mass 4 is adjustable upwards when fluid is introduced into chamber 13. As seen in FIG. 1, the numeral 15 designates the distance between the edge of diaphragm 5 and the side walls 3. Desirably, the distance is equal to about $\frac{1}{8}$ to 1/12 of the inner diameter of the pressurized compartment.

The pressure medium is introduced into the compartment from the outside through channel 12. The pressure medium exits upwards through orifice 16 located in the middle of diaphragm 5 and distributes itself between diaphragm 5 and elastomeric mass 4 forming chamber 13. This results in an enlargement of the enclosed volume within pressurized compartment 14 and causes lifting of cover 1.

An adjustable load support is shown in lifted position in the right half of FIG. 1. In this illustration, the hollow chamber 13 which is filled with a pressure medium can clearly be seen.

Above orifice 16 in diaphragm 5, a protective disk 10 has been placed in elastomeric mass 4. The purpose of disk 10 is to protect elastomeric mass 4 against erosion which occurs when the pressure medium is introduced into the pressurized compartment.

Figure 2:
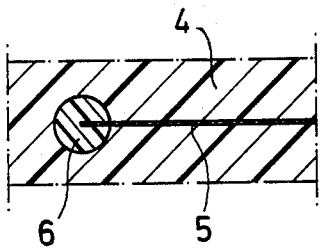
FIG. 2 shows an enlarged view of a detail of FIG. 1.

FIG. 2 illustrates in an enlarged view a surrounding ring 6 which is on the periphery of diaphragm 5. Ring 6 may be made of the same material as diaphragm 5 or else may be made from a metal. The purpose of ring 6 is to reduce the stress between the edge of diaphragm 5 and elastomeric mass 4.

Figure 3:
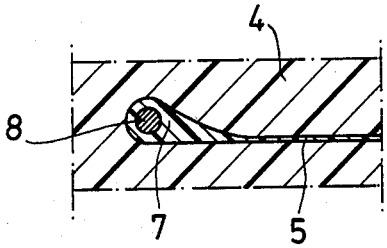
FIG. 3 is an alternative embodiment of the detail shown in FIG. 2.

FIG. 3 illustrates, also in an enlarged view, a different embodiment of a protective device for diaphragm 5. An upwardly curved reinforcement 7 is formed at the periphery of diaphragm 5. Inside reinforcement 7 is surrounding ring 8. In this embodiment, diaphragm 5 and reinforcement 7 are made from the same artificial material while surrounding ring 8 is made from metal.

Although the invention has been described with reference to specific embodiment, this was for purposes of illustration only and hence should not be construed to limit the spirit or the scope of the invention.

Having thus described the invention, what we claim as new and desire to be secured by Letters Patent is as follows:

1. An adjustable load support for lifting and lowering heavy loads, comprising a hollow container having a bottom, sidewalls, and a liftable top, sealing means for sealing a portion of said top within said hollow container, an elastomeric mass substantially filling the interior of said container, means for introducing a pressurized medium into the interior of said container, and a diaphragm between the bottom of said elastomeric mass and the bottom of said container, said diaphragm being substantially parallel to the plane of the bottom of said container and having an edge which is not in contact with the sidewalls of said container, whereby hydraulic fluid is introduced into said container between said diaphragm and said elastomeric mass through an opening in said diaphragm, and said top is lifted upwards.

2. The load support of claim 1, further comprising a nozzle in fluid communication with said means for introducing a pressurized medium, whereby the pressurized medium is introduced and withdrawn from said container through said nozzle.

3. The load support of claim 2 wherein said nozzle is releasably connected to said bottom of said container.

4. The load support of claim 1 wherein said diaphragm is made from an artificial material.

5. The load support of claim 1 wherein the edge of said diaphragm is a distance from the sidewalls of said container equal to about $\frac{1}{8}$ to about 1/12 of the inside diameter of said container.

6. The load support of claim 1 wherein said diaphragm is provided with a surrounding ring at its periphery.

7. The load support of claim 6 wherein said surrounding ring is made from an artificial material.

8. The load support of claim 6 wherein said diaphragm is provided with an upwardly curving reinforcement at its periphery, said reinforcement having a surrounding metal ring embedded therein.

9. The load support of claim 1, wherein said diaphragm is made from metal.

10. The load support of claim 6, wherein said surrounding ring is made from metal.

* * * * *